US011111787B2

(12) United States Patent
Moore

(10) Patent No.: US 11,111,787 B2
(45) Date of Patent: Sep. 7, 2021

(54) METHOD AND AN APPARATUS FOR CREATING A VOID FOR UNDERGROUND MINING

(71) Applicant: EVOLUTION RESOURCE GROUP PTY LTD, Singelton (AU)

(72) Inventor: Gregory Moore, Singelton (AU)

(73) Assignee: Moore Management Company Pty Ltd, Singelton (AU)

( * ) Notice: Subject to any disclaimer, the term of this patent is extended or adjusted under 35 U.S.C. 154(b) by 0 days.

(21) Appl. No.: 15/752,093

(22) PCT Filed: Aug. 12, 2016

(86) PCT No.: PCT/AU2016/000274
§ 371 (c)(1),
(2) Date: Feb. 12, 2018

(87) PCT Pub. No.: WO2017/024334
PCT Pub. Date: Feb. 16, 2017

(65) Prior Publication Data

US 2018/0238171 A1 Aug. 23, 2018

(30) Foreign Application Priority Data

Aug. 12, 2015 (AU) ..... 2015903223

(51) Int. Cl.

| | |
|---|---|
| ***E21F 15/00*** | (2006.01) |
| ***E21F 15/04*** | (2006.01) |
| ***E21C 41/16*** | (2006.01) |
| ***E21F 15/02*** | (2006.01) |
| *E21C 37/16* | (2006.01) |
| *E21C 41/22* | (2006.01) |

(52) U.S. Cl.
CPC ..... *E21F 15/04* (2013.01); *E21C 41/16* (2013.01); *E21F 15/005* (2013.01); *E21F 15/02* (2013.01); *E21C 37/16* (2013.01); *E21C 41/22* (2013.01)

(58) Field of Classification Search
CPC ..... E21F 15/02; E21F 15/04
See application file for complete search history.

(56) References Cited

U.S. PATENT DOCUMENTS

| | | | | |
|---|---|---|---|---|
| 4,056,939 A * | 11/1977 | Alvarez-Calderon | E21C 41/16 249/65 |
| 5,015,123 A * | 5/1991 | Houck | E02B 11/00 405/36 |
| 5,216,863 A * | 6/1993 | Nessa | E02D 5/08 249/173 |
| 6,547,493 B2 * | 4/2003 | Spangler | E02B 3/04 405/302.6 |

(Continued)

FOREIGN PATENT DOCUMENTS

AU 2009236027 12/2010

OTHER PUBLICATIONS

International Search Report for PCT/AU2016/000274, Completed by the Australian Patent Office dated Sep. 2, 2016, 4 Pages.

*Primary Examiner* — Janine M Kreck
(74) *Attorney, Agent, or Firm* — Brooks Kushman P.C.

(57) ABSTRACT

A method and an apparatus for creating a void, low-density fill or combination of void and low-density fill for underground mining having at least one module of formwork to be positioned in an open slope of an underground mine prior to carrying out a backfilling operation.

5 Claims, 6 Drawing Sheets

(56) References Cited

U.S. PATENT DOCUMENTS

| | | | | |
|---|---|---|---|---|
| 6,857,706 | B2 | 2/2005 | Hames et al. | |
| 8,424,973 | B2 * | 4/2013 | Bodley | E21C 41/16 299/10 |
| 2008/0173205 | A1 * | 7/2008 | Hawkins | F42D 1/18 102/333 |
| 2010/0295359 | A1 | 11/2010 | Bodley et al. | |
| 2014/0023444 | A1 | 1/2014 | Kingsley | |

* cited by examiner

METHOD AND AN APPARATUS FOR CREATING A VOID FOR UNDERGROUND MINING

CROSS-REFERENCE TO RELATED APPLICATION

This application is the U.S. national phase of PCT Application No. PCT/AU2016/000274 filed on Aug. 12, 2016, which claims priority to AU Patent Application No. 2015903223 filed on Aug. 12, 2015 the disclosures of which are incorporated in their entirety by reference herein.

FIELD OF THE INVENTION

The present invention relates to methods and equipment used for underground mining for mineral or metal deposits. In particular, but not exclusively, the present invention relates to a method and apparatus for creating a void, low-density fill or combination of void and low-density fill for underground mining. However, it will be appreciated that the present invention has broader application and is not limited to that particular use.

BACKGROUND TO THE INVENTION

Metals or minerals are often contained in underground deposits referred to in the art as "ore bodies". These ore bodies are typically located in high strength rock and at varying depths. During mining operations, each cut or "panel" of ore is removed sequentially by drilling a plurality of vertically or semi vertical boreholes, loading explosive charges into each borehole and blasting. The blasted ore or rock material is gathered or "mucked" to a loading or draw point. Thereafter, a cavity referred to in the art as a "stope" is created by removal of the broken ore. This cavity or "stope" is backfilled with waste material such as rock, crushed aggregate, mine tailings, concrete, cemented rock fill or paste fill. The backfill and the method of backfill can vary greatly between mining operations. Mine tailings or past backfill is usually placed by pumping the fill material into the stope or void. Where waste rock or crushed rock is produced and is to be used as backfill, the material is usually deposited into the "stope" by a front end loader or other mechanical means.

Several methods have been developed to mine such ore bodies to recover the valuable metals or minerals, some examples of which are described, in U.S. Pat. No. 6,857,706 and AU Patent 2009236027. U.S. Pat. No. 4,056,939 and AU 2009236027 both describe the use of inflatable devices to create voids and place paste or slurry backfill these inflatable devices rely on a continuous supply of mine air, are complex and often fail due to puncture or leakage. While these inflatable devices may have some success in paste or slurry backfill operations they are not suitable where the backfill material is rock or crushed rock or in situations where the backfilling process involves impact on the device which is creating the void or low-density space.

Once the backfilling operation has been completed the next step in the mining process is to create a void in the backfill adjacent to the un-mined ore body. Historically the void has been created by either a series of drilling and blasting known in the industry as a "burn cut" or by drilling and boring a rise adjacent the un-mined ore body. The creation of the void adjacent to the un-mined ore body provides a space during the basting process for the newly blasted ore body to expand into.

As rock is blasted, the release of pressure causes it to expand and fragment therefore occupying a larger volume than before. Using the processes of the prior art, a space or void for receiving the fragmented rock is created by mining an elongated substantially vertical or inclined shaft extending between a lower level and an upper level of the mine, referred to in the art as a "rise". However, developing a rise for every production panel of the stope being mined can be both time-consuming and expensive.

Typically, in underground hard rock mining operations, the previous area mined is backfilled with waste material prior to the next ore body being removed for processing. After the backfilling is completed a void referred to in the industry as a rise or burn cut is established to allow the blasting of the un-mined ore body to commence. The void or space of low-density fill is used during the blasting of the un-mined ore and allows the newly blasted ore a space or void in which to expand into during the blasting process.

In this specification, the terms "comprises", "comprising" or similar terms are intended to mean a non-exclusive inclusion, such that a method and apparatus for creating a for creating a void, low-density fill or combination of void and low-density fill for underground mining that comprises a list of elements does not include those elements solely, but may well include other elements not listed.

OBJECT OF THE INVENTION

It is a preferred object of the present invention to provide a method and apparatus for creating a void, low-density fill or combination of void and low-density fill for underground mining, that addresses or at least ameliorates one or more of the aforementioned problems of the prior art and/or provides consumers with a useful or commercial choice.

SUMMARY OF THE INVENTION

Generally, embodiments of the present invention relate to a method and apparatus for creating a void, low-density fill or combination of void and low-density fill for underground mining.

According to one aspect, although not necessarily the broadest aspect, the present invention resides in an apparatus for creating a void, low-density fill or combination of void and low-density fill for underground mining comprising at least one module of formwork to be positioned in an open stope of an underground mine prior to carrying out a backfilling operation.

Preferably, the at least one module of formwork is in the form of a hollow cylinder or pipe.

Preferably, the apparatus comprises a body portion and at least one fastening or anchor point provided on at least one end of the body portion to be used to join and secure adjacent modules of formwork together via a fastening member.

Preferably, the at least one fastening or anchor point is in the form of an aperture to receive at least one fastening member therethrough.

Preferably, the fastening member is in the form of a rope or flexible strapping which is threaded through the at least one fastening or anchor point in the at least one flange of the formwork and secured on at least one end.

Preferably, the apparatus is suitably sized to enable handling in an underground environment.

Preferably, the at least one module of formwork is constructed from a lightweight semi-rigid or rigid low-density material, such as polystyrene, polyurethane or the like, low-density concrete or any other suitable material or combination of materials.

Preferably, the thickness of the at least one module of formwork can be varied to suit the type of fill and the method of installing the fill. Suitably, the at least one module of formwork comprises an external protective layer to absorb the impact of the backfilling operation.

According to another aspect, although again not necessarily the broadest aspect, the present invention resides in an apparatus for creating a void, low-density fill or combination of void and low-density fill for underground mining comprising at least two modules of cylindrical formwork of the same and/or different sizes arranged together and secured via a fastening member to be positioned in an open stope of an underground mine prior to a backfilling operation.

Preferably, the at least two modules of cylindrical formwork are in the form of semi-rigid pipes.

Preferably, the fastening member is in the form of binding, such as a rope or net or other suitable fastening or securing means, which is wrapped around the modules of formwork to bind and hold the arrangement.

According to yet another aspect, although again not necessarily the broadest aspect, the present invention resides in an apparatus for creating a void, low-density fill or combination of void and low-density fill for underground mining comprising at least one module of formwork to be positioned in an open stope of an underground mine prior to a backfilling operation wherein, the at least one module of formwork has at least one internal profile to form an inner air void to provide for a volume for blasted ore to expand into and at least one built-in anchor point to enable adjacent modules of formwork to be joined together by a fastening member.

Preferably, the fastening member is rope, strapping or any other suitable fastening means.

Suitably, the at least one module of formwork may further comprise a pair of endplates which are positioned at and cover either end of the formwork to seal one or more air voids.

Suitably, the endplates can be cast into the formwork or may be attached to the formwork using strapping and comprise at least one anchor point provided on an endpoint for securing adjacent modules of formwork together.

According to a further aspect, although again not necessarily the broadest aspect, the present invention resides in a method for creating a void, low-density fill or comprising the following steps:

placing an apparatus comprising at least one module of formwork in an open stope prior to the stope being backfilled, wherein the apparatus creates a void or low-density fill into which fragmented ore can expand during at least one subsequent blasting operation for a second or subsequent panel; and maintaining the void or low-density fill until blasting operations occur whereupon the void or low-density fill is caused to collapse to accommodate fragmented ore generated during the at least one subsequent blasting operation.

According to another aspect, although again not necessarily the broadest aspect, the present invention resides in a method for creating a void, low-density fill or comprising the following steps:

assembling at least two or more modules of formwork together to form an assembled length of formwork for an apparatus of a desired length required for an open stope;

installing the apparatus in an open stope and securing it in place prior to the stope being backfilled, wherein the apparatus creates a void or low-density fill into which fragmented ore can expand during at least one subsequent blasting operation for a second or subsequent panel; and maintaining the void or low-density fill until blasting operations occur whereupon the void or low-density fill is caused to collapse to accommodate fragmented ore generated during the at least one subsequent blasting.

Further features and forms of the present invention will become apparent from the following detailed description.

BRIEF DESCRIPTION OF THE DRAWINGS

In order that the invention may be readily understood and put into practical effect, reference will now be made to embodiments of the present invention with reference to the accompanying drawings, wherein like reference numbers refer to identical elements. The drawings are provided by way of example only, wherein.

Figure 1:
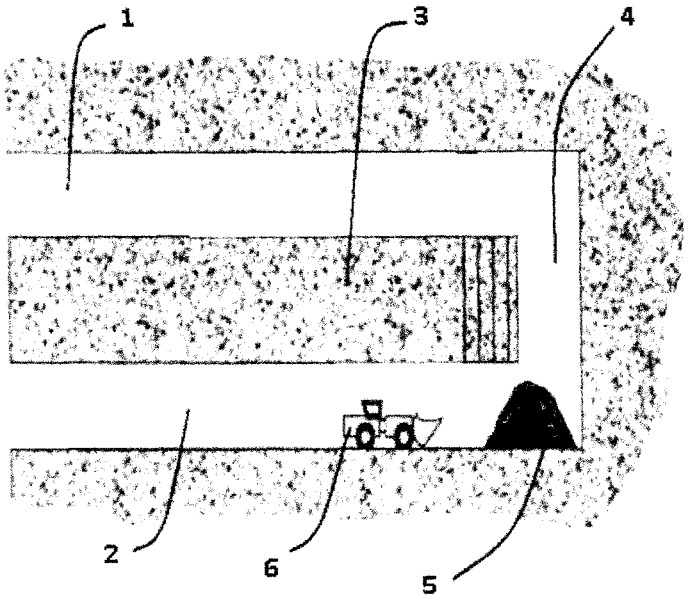
FIG. 1 shows a cross-sectional side view of an underground mine showing the location of an ore body.

Skilled addressees will appreciate that elements in the drawings are illustrated for simplicity and clarity and have not necessarily been drawn to scale. For example, the relative dimensions of some of the elements in the drawings may be distorted to help improve understanding of embodiments of the present invention.

DETAILED DESCRIPTION OF THE INVENTION

Embodiments of the present invention will be described with reference to a method and apparatus to create and maintain a void, low-density fill or combination of void and low-density fill during backfill operations. This void, low-density fill or combination of void and low-density fill provides space for the newly blasted ore to expand into. However, it should be appreciated that embodiments of the present invention can be modified to suit any other suitable applications. It will be appreciated that variations may need to be made as required.

Figure 2:
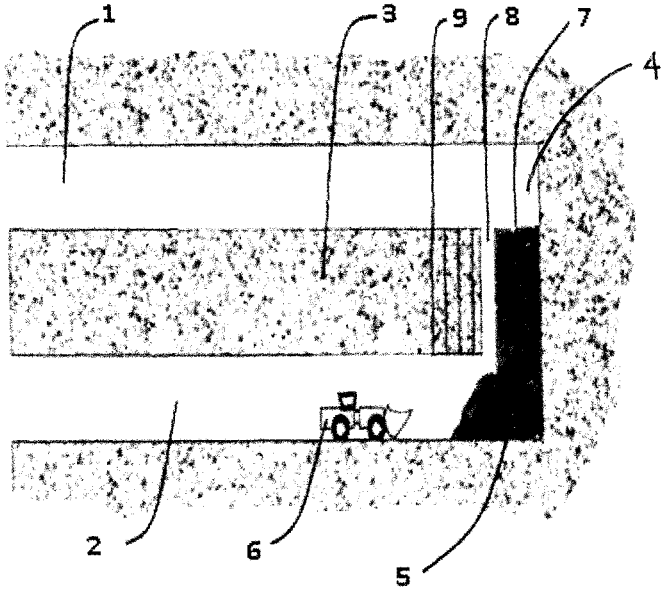
FIG. 2 shows a cross-sectional side view of the underground mine of FIG. 1 in which a formwork has been installed within an open stope to create a void and the back-filling operation has been completed.
Figure 3:
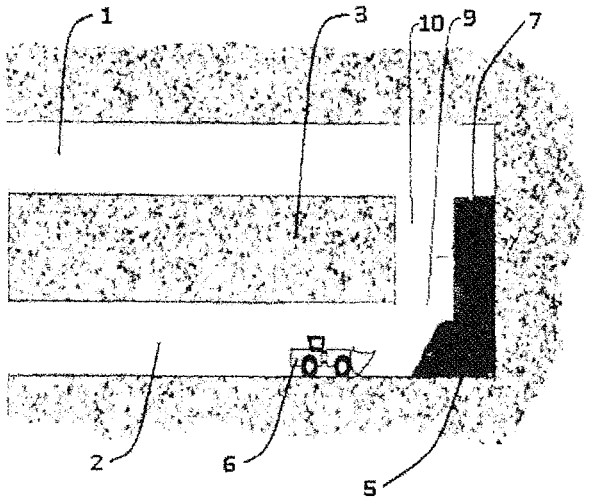
FIG. 3 is a cross-sectional side view of the underground mine of FIG. 1 after the ore has been blasted.

Referring to FIGS. 1 to 3, a method to create a void, low-density fill or combination of void and low-density fill during backfill operations is provided in accordance with embodiments of the present invention. FIG. 1 illustrates an underground mine showing the location of an ore body 3 within the underground mine positioned between an upper drive 1 and a lower drive 2. Some blasted ore or rock material is shown gathered or "mucked" into a pile 5 that is in the process of being loaded by a front loader 6 to create a cavity or an open stope 4 by removal of the broken ore. As illustrated in FIG. 2, a void 8 or low-density fill is created during the backfilling process, via an apparatus which will be demonstrated later herein, into which fragmented ore can expand during subsequent blasting operations for a second or subsequent panel. The ore body is drilled and prepared for blasting 9 in order to create blasted ore for processing. The open stope 4 is backfilled with fill 7 which can consist of, but not be limited to, cemented rock or paste, crushed or uncrushed rock, all of which are waste ore from the preceding mining operations to complete the backfilling operation. Referring to FIG. 3, after the blasting, the blasted ore 9 is ready to be loaded out by the front loader 6 for processing. A new open stope 10 has been formed ready for the mining process to start again.

Referring to FIGS. 4 to 14, an apparatus 100 to create a void, low-density fill or combination of void and low-density fill during backfill operations is provided in accordance with embodiments of the present invention. The apparatus comprises at least one module of formwork 11. The body portion 11*a* of the formwork 11 is in the form of a hollow cylinder or pipe. The modules of formwork 11 are suitably sized to enable handling in an underground environment. It will be acknowledged that the dimensions and style of the formwork can be varied to suit different applications or preferences. It will also be acknowledged that any other suitable shape or configuration may also be adopted. It is envisaged that the formwork 11 will be constructed from a lightweight low-density material, such as polystyrene, polyurethane or the like, low-density concrete or any other suitable material or combination of materials. Polyurethane has the advantage that it can be manufactured with a variety of densities and thus, can be easily tailored to the specific application. The present invention allows for varying materials and designs to be used and the choice of materials and design is largely dependent on the type of backfill, the method of backfill and the location and angle of the required void or low-density fill. Where the type of fill or the method of installing the backfill will cause impact on some or all of the formwork 11 then it is preferable some or all of the formwork 11 be made of composite materials. These materials may consist of a low-density polystyrene or polyurethane. The formwork 11 can be protected from impact by further comprising an external protective layer of impact resistant durable material such as timber, plastics, composites or steel.

Figure 4:
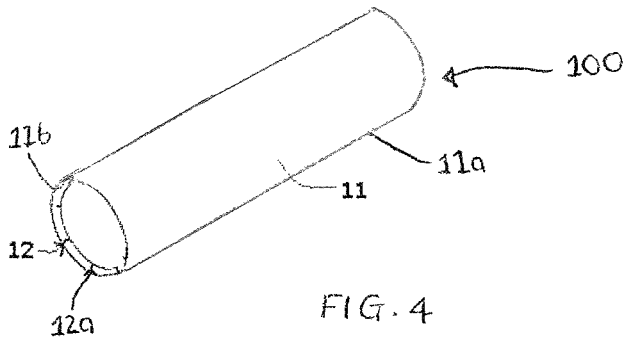
FIG. 4 is a perspective view of an apparatus comprising a module of formwork according to an embodiment of the present invention.
Figure 5:
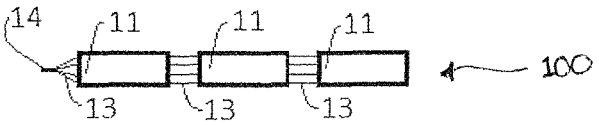
FIG. 5 is a side view of the apparatus of FIG. 4 comprising more than one modules of formwork joined together to form the desired length of formwork for the apparatus.
Figure 6:
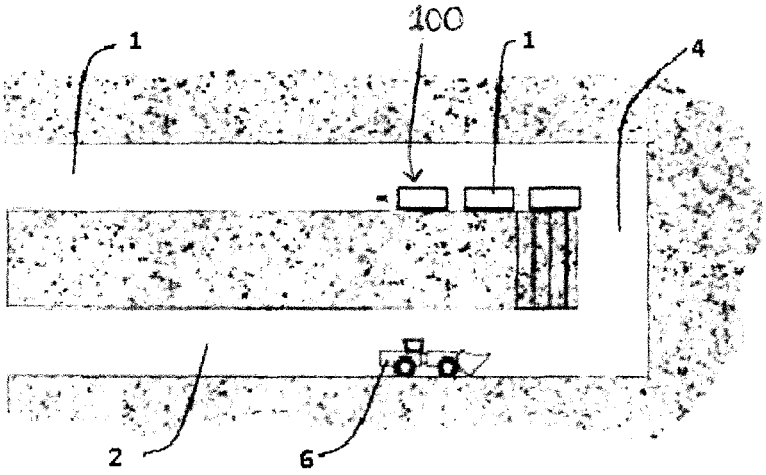
FIG. 6 is a cross-sectional side view of the underground mine of FIG. 1 wherein the apparatus of FIG. 5 is ready to be installed into the open stope of the underground mine prior to the backfilling operation.
Figure 7:
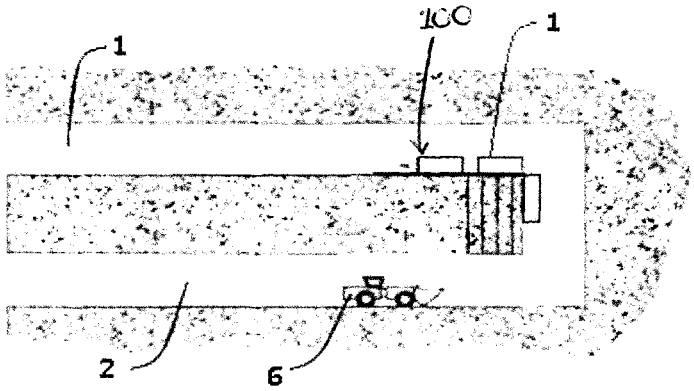
FIG. 7 is a cross-sectional side view of the underground mine of FIG. 1 wherein the apparatus of FIG. 5 is in the process of being installed within the open stope of the underground mine prior to the backfilling operation.
Figure 8:
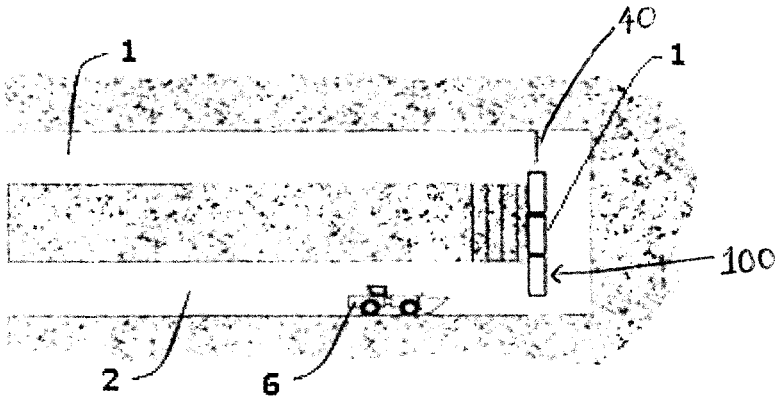
FIG. 8 is a cross-sectional side view of the underground mine of FIG. 1 wherein the apparatus of FIG. 5 is installed within the open stope of the underground mine ready for the backfilling operation.

As illustrated in FIG. 4, the formwork comprises at least one internal flange 12 located on at least one end 11*b* of the body portion 11*a* of the formwork 11. Provided on the internal flange(s) 12 and/or on the at least one end 11*b* of the body portion 11*a* is at least one fastening or anchor point 12*a* which is adapted to be used to join and secure adjacent modules of formwork together during installation and/or use of the apparatus 100. The fastening or anchor point 12*a* is in the form of an aperture which is adapted to receive at least one fastening member therethrough such that, one or more modules of formwork 11 can be joined together to form the desired length of formwork for the apparatus 100 to suit the particular application, as illustrated in FIG. 5. As shown in FIG. 5, the fastening member 13 is in the form of a rope or flexible strapping which is threaded through the apertures 12*a* in the internal flange(s) 12 of the formwork 11 and secured on at least one end 14. However, it is envisaged that any other suitable fastening means for joining adjacent modules of formwork 11 of the apparatus 100 could also be adopted such as clips or other suitable fixings. FIG. 6 illustrates the apparatus 100 comprising a plurality of modules of formwork 11 which have been joined together in an assembled configuration of the desired length ready to be installed into the open stope 4 prior to the back-filling operation. FIG. 7 illustrates the apparatus 100 comprising the plurality of formwork modules 11 of the desired length in the process of being installed into the open stope 4 prior to the back-filling operation. FIG. 8 illustrates the apparatus 100 comprising the plurality of formwork modules 11 of the desired length, to reach from the upper drive 1 to the lower drive 2, installed within the open stope 4 and anchored in place via a securing member 40 such as rope cable, webbing or strapping ready for the back-filling operation. In some cases, the apparatus 100 may comprise multiple assembled sets of the plurality of modules of formwork 11 of the desired length which may be placed side by side thus, increasing the volume of the void/low-density fill.

The apparatus 100 is located against the un-mined ore body and provides a barrier during the backfilling operation. The barrier provided by the apparatus 100 prevents the backfill from entering the area adjacent to the un-mined ore body and provides a space or volume consisting of low-density fill, void or a combination thereof. This void and/or low-density fill provides a space or void for the future un-mined ore blasting process. The blasting process causes the un-mined ore to expand into the void and low-density fill created by the apparatus 100 of the present invention by giving the ore an area or space to expand into. Without a space to expand into, the blast will be ineffective. Generally, the larger and less dense the area is for expansion, the more effective the blast.

Figure 9:
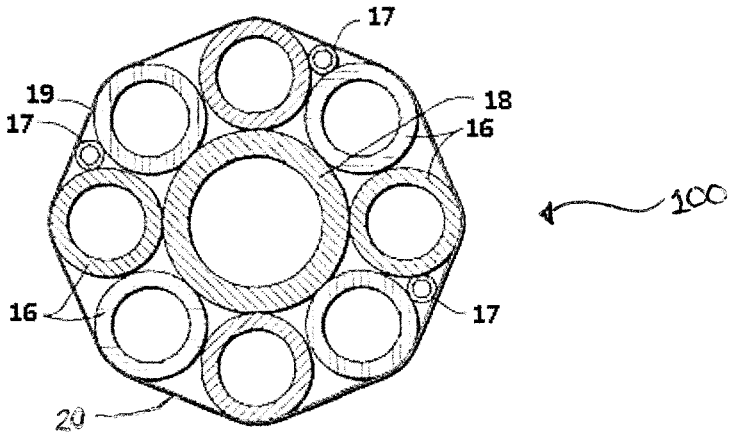
FIG. 9 is a cross-sectional end view of an alternative module of formwork for the apparatus according to the present invention.
Figure 10:
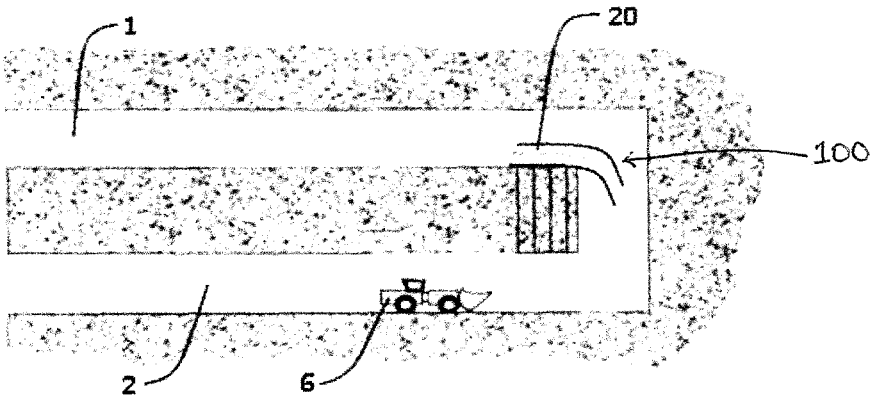
FIG. 10 shows a cross-sectional side view of the underground mine of FIG. 1 wherein the apparatus of FIG. 9 is in the process of being installed within the open stope of the underground mine prior to the backfilling operation.

Referring now to FIG. 9, in a further embodiment, the apparatus 100 comprises at least one module of formwork 20 having at least one semi-rigid pipe 16,17,18 which can be of the same size or various sizes and can be arranged together to form the apparatus 100 to create a void of a desired size. As illustrated in FIG. 9, the various sized pipes 16,17,18 are arranged together to form a suitably sized apparatus 100 and thus, a suitably sized void. A fastening member 19 in the form of binding, such as a rope or net or other suitable fastening or securing means, is wrapped around the outer modules of formwork 16,17 of the arrangement to bind and hold the arrangement. The binding 19 is preferably loose to enable the modules of formwork to slip within the binding 19 and allow the structure and apparatus 100 to bend. As illustrated in FIG. 10, the smaller modules formwork sections allow a smaller bending radius to be achieved during the installation process into the open stope. Longer lengths of formwork may also be used and installed without joining.

Figure 11:
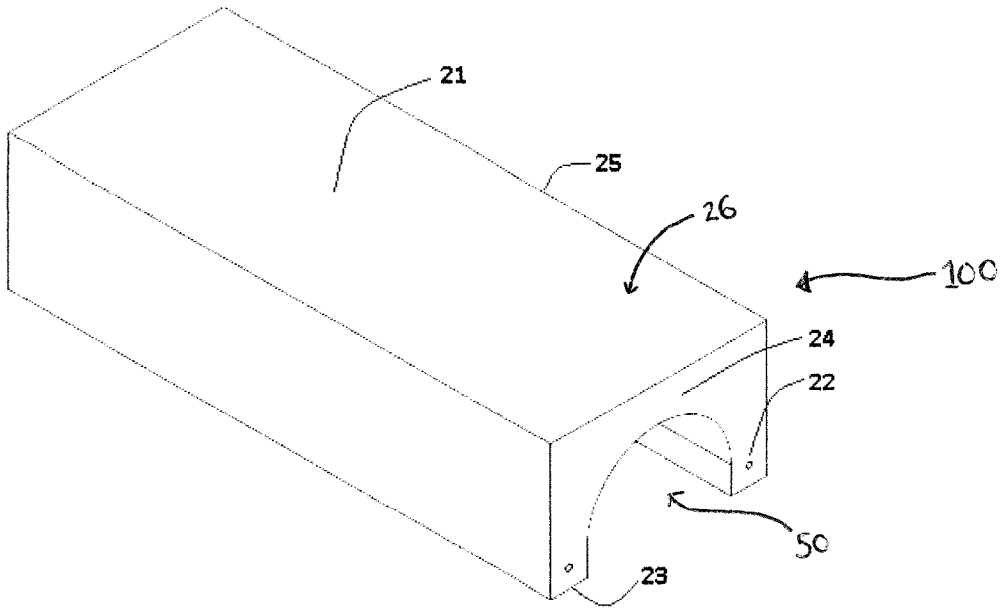
FIG. 11 shows a perspective view of an alternative module of formwork for the apparatus according to the present invention.
Figure 12:
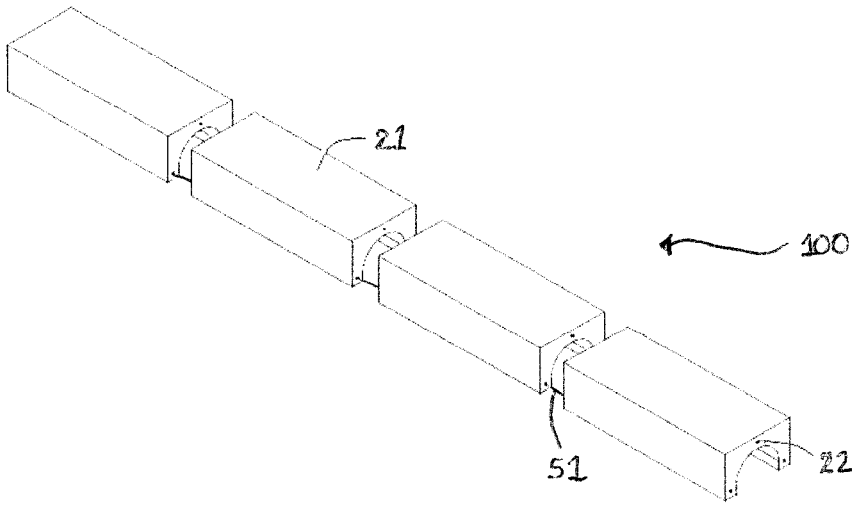
FIG. 12 shows a perspective view of the apparatus comprising more than one alternative modules of formwork of FIG. 11 joined together to form the desired length of formwork for the apparatus.
Figure 14:
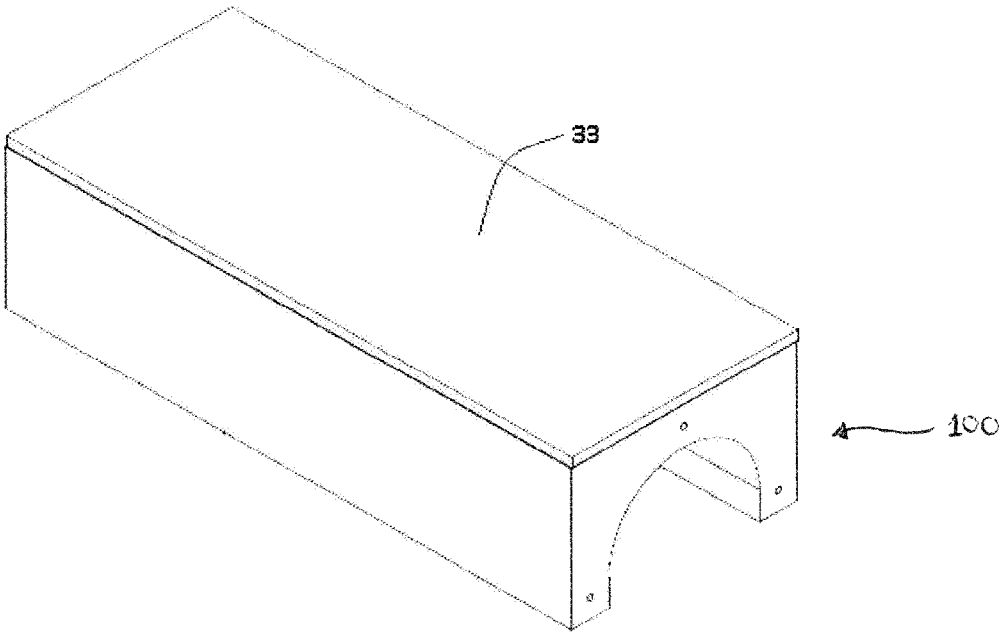
FIG. 14 shows the alternative module of formwork of FIG. 11 further comprising a protective layer.

Referring now to FIG. 11, in a further embodiment, the apparatus comprises at least one module of formwork 21 made of a low-density rigid or semi rigid material such as polystyrene, polyurethane or a lightweight cement/concrete. In this embodiment, the module(s) of formwork 21 is in the shape of a rectangular prism with an internal profile configured to create a void, such as an arch or any other suitable shape or profile. In practice, it is envisaged that the formwork 21 can be provided in any suitable shape and any edges 25 on the formwork can be rounded or be protected with another denser material to protect the formwork from any impact that may be incurred during the backfilling operation. The apparatus 100 in this embodiment uses the low-density rigid or semi rigid material as outer formwork 24 and its shape incorporates an inner air void 50 between the blasting face 26 and the feet of the arch 23. The inner air void 50 further reduces the combined density and thus provides for a more effective volume for the blast to expand into. The installation requires the arch feet and inner air void 50 created by the arch to be placed against the area to be blasted and the arch roof to face towards the open stope. It is envisaged that the thickness of the modules of formwork 21 of the apparatus 100 can be varied to suit the type of fill and the methods of installing the fill. The modules of formwork 21 of the apparatus 100 comprise built-in anchor points 22 which are adapted to enable adjacent modules of formwork 21 to be joined together to form the apparatus 100, as illustrated in FIG. 12, where several modules of formwork 21 are laid out ready to be joined together via the built-in anchor points 22 and a fastening member 51 such as rope, strapping or any other suitable fastening or securing means. It is envisaged that the modules of formwork 21 of the apparatus 100 may further comprise a protective layer 33, as illustrated in FIG. 14. This protective layer is preferably incorporated onto the outer surface of the formwork 21 and is designed to absorb the impact of the backfilling operation and protect the modules of formwork 21 of the apparatus 100 from any impact that may be incurred as a result of the backfilling operation. This protective layer 33 may be used on all the modules of formwork used or to only some of the modules of formwork as these may be the only modules impacted during the backfill operation.

Figure 13:
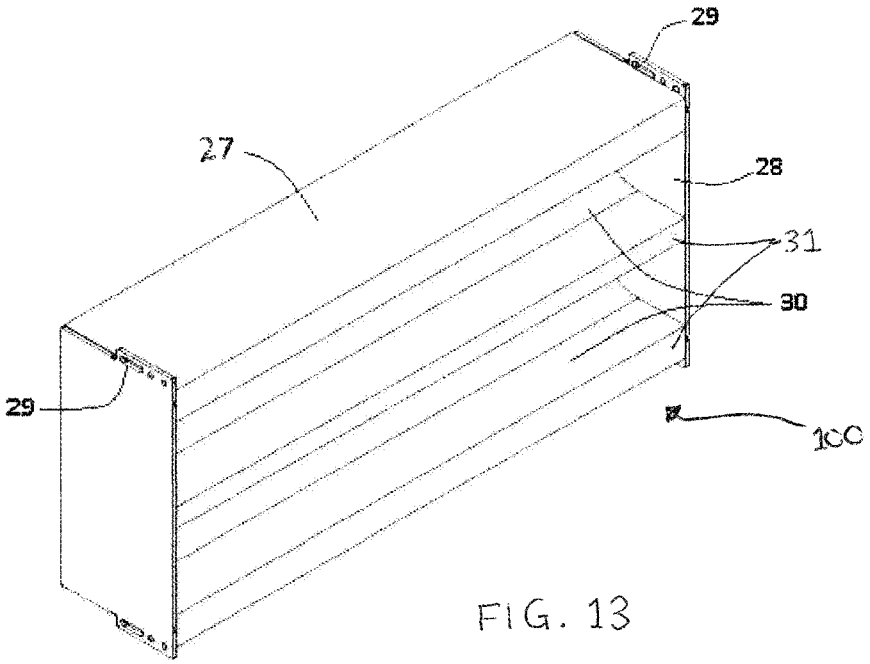
FIG. 13 shows a perspective view of an alternative module of formwork for the apparatus according to the present invention.

As illustrated in FIG. 13, in a further embodiment, the apparatus 100 can externally have a variety of shapes and sizes for the modules of formwork 27 and internally have internal profiles to create inner air voids 30 of various shapes and sizes. According to the embodiment shown in FIG. 13, the formwork 27 is configured such that it is shaped to have an internal profile comprising two arches 31, a design which strengthens the module of formwork 27. The module of formwork 27 may also further comprise a pair of endplates 28 which are adapted to be positioned at and cover either end of the formwork 27 to seal the inner air voids 30 created by the arches 31. The endplates 28 can be cast into the formwork 26 or may be attached to the formwork 26 using a suitable means such as strapping. The endplates 28 are designed to prevent backfill from entering the inner air voids 30 created by the arches 31. The end plates 28 are preferably made from a more rigid and dense material than the general body of the formwork for example, timber, polypropylene, polyethylene, a composite material or any other suitable material or combination thereof. The endplates 28 comprise at least one anchor point 29. It is envisaged that anchor points 29 will be provided at both the top and bottom ends of the endplates 28 for securing adjacent modules of formwork 27 together.

Hence, the present invention provides a solution to the aforementioned problems of the prior art by providing to a method and apparatus to create and maintain a void or volume of low-density during backfill operations. This invention allows the void or volume of low-density to be developed during the backfilling operations thus improving the mining process. The ability to develop a void or low-density space during the backfilling operation reduces the time involved in the mining cycle and the cost of creating the void or low-density void space. The present invention allows for a void, low-density space or combination of void and low-density space to be reliably developed during any type backfill or any method of backfilling operation.

The reference to any prior art in this specification is and should not be taken as, an acknowledgment or any form or suggestion that the prior art forms part of the common general knowledge.

Throughout the specification the aim has been to describe the invention without limiting the invention to any one embodiment or specific collection of features. Persons skilled in the relevant art may realize variations from the specific embodiments that will nonetheless fall within the scope of the invention.

I claim:

1. A method for creating a void during underground mining, the method comprising the following steps:

placing an apparatus comprising at least one module of formwork comprising having a body portion made of a lightweight low-density material and at least one fastening or anchor point provided on at least one end of the body portion to be used to join and secure adjacent modules of formwork together to achieve a desired length or configuration, or install the formwork, and provide a low-density fill or combination of void and low-density fill in an open stope prior to the stope being backfilled, wherein the apparatus creates a void or low-density fill without requiring inflation or filling of the formwork into which fragmented ore can expand during at least one subsequent blasting operation for a second or subsequent panel; and maintaining the low-density fill or void and low-density fill until blasting operations occur whereupon the low-density fill or void and low-density fill is caused to collapse to accommodate fragmented ore generated during the at least one subsequent blasting operation.

2. A method for creating a void, for underground mining, the method comprising the following steps:

assembling at least two or more modules of formwork comprising having a body portion made of a lightweight low-density material and at least one fastening or anchor point provided on at least one end of the body portion to be used to join and secure adjacent modules of formwork together to achieve a desired length or configuration, or install the formwork, and provide a low-density fill or combination of void and low-density fill which together to form an assembled length of formwork for an apparatus of a desired length required for an open stope;

installing the apparatus in an open stope and securing it in place prior to the stope being backfilled, wherein the apparatus creates a void or low-density fill without requiring inflation or filling of the formwork into which fragmented ore can expand during at least one subsequent blasting operation for a second or subsequent panel; and maintaining the configuration of the modules of formwork until blasting operations occur whereupon the void or low-density fill is caused to collapse to accommodate fragmented ore generated during the at least one subsequent blasting.

3. An apparatus for creating a void during underground mining, the apparatus comprising:

at least one module of formwork having a body portion made of a lightweight low-density material and at least one flange provided on at least one end of the body portion of the formwork; and at least one fastening or anchor point, in the form of an aperture sized to receive at least one fastening member therethrough, provided on the at least one end of the body portion to be used to join and secure adjacent modules of formwork together to achieve a desired length or configuration, or install the formwork, said fastening member being in the form of a rope or flexible strapping which is threaded through the at least one fastening or anchor point in the at least one flange of the formwork and secured on the at least one end;

wherein the apparatus provides a low-density fill or combination of void and low-density fill in an open stope prior to the stope being backfilled, and creates a void or low-density fill without requiring inflation or filling of the formwork into which fragmented ore can expand during at least one subsequent blasting operation.

4. An apparatus for creating a void during underground mining, the apparatus comprising:

at least one module of formwork having a body portion made of a lightweight low-density material, at least one internal profile to form an inner air void to provide for a volume for blasted ore to expand into, a pair of endplates which a positioned at and cover an end of the formwork to at least partially enclose the one or more voids and at least one flange provided on at least one end of the body portion of the formwork; and at least one fastening or anchor point, in the form of an aperture sized to receive at least one fastening member therethrough, provided on the at least one end of the body portion to be used to join and secure adjacent modules of formwork together to achieve a desired length or configuration, or install the formwork, said fastening member being in the form of a rope or flexible strapping which is threaded through the at least one fastening or anchor point in the at least one flange of the formwork and secured on the at least one end;

wherein the apparatus provides a low-density fill or combination of void and low-density fill in an open stope prior to the stope being backfilled, and creates a void or low-density fill without requiring inflation or filling of the formwork into which fragmented ore can expand during at least one subsequent blasting operation.

5. The apparatus of claim 4, wherein the endplates can be cast into the formwork or may be attached to the formwork using strapping and comprise at least one anchor point provided on an endpoint for securing adjacent modules of formwork together.

* * * * *